United States Patent [19]

Sato

[11] Patent Number: 4,790,066

[45] Date of Patent: Dec. 13, 1988

[54] ELECTRICAL CONNECTOR ASSEMBLY MACHINE

[75] Inventor: Kensaku Sato, Tokyo, Japan

[73] Assignee: Hirose Electric Co., Ltd., Tokyo, Japan

[21] Appl. No.: 128,922

[22] Filed: Dec. 4, 1987

[30] Foreign Application Priority Data

Dec. 5, 1986 [JP] Japan ..... 61-186880[U]

[51] Int. Cl.[4] ..... H01R 43/00

[52] U.S. Cl. ..... 29/747; 29/742; 29/753; 29/757; 29/759; 29/884

[58] Field of Search ..... 29/747, 748, 742, 745, 29/759, 753, 755, 757, 884, 881

[56] References Cited

U.S. PATENT DOCUMENTS 3,641,646 2/1972 Folk ..... 29/745 X
4,171,566 10/1979 Tominoi ..... 29/748
4,272,879 6/1981 Wigby et al. ..... 29/884
4,395,818 8/1983 Jackson ..... 29/747

*Primary Examiner*—Carl E. Hall
*Attorney, Agent, or Firm*—Takeuchi Patent Office

[57] ABSTRACT

An electrical connector assembly machine for loading an insulating housing having a plurality of parallel apertures with a plurality of contacts. It consists of a housing support for supporting the insulating housing; a table having a plurality of parallel channels at equal intervals and in registration with the parallel apertures for receiving the contacts; a pusher disposed over the table so as to be movable vertically and laterally along the parallel channels and having a plurality of grooves for receiving conductor sections of the contacts when the pusher is lowered. The grooves each have at the front edge a jaw portion for pushing forward crimped strain relief tabs of the contact.

2 Claims, 2 Drawing Sheets

ELECTRICAL CONNECTOR ASSEMBLY MACHINE

BACKGROUND OF THE INVENTION

The present invention relates to electrical connector assembly machines for loading a housing with a number of contacts to which conductors have been terminated by crimping or piercing.

Japanese Patent Kokai No. 61-74211 discloses an automatic crimping and loading machine for loading an electrical connector with electrical contacts to which conductors have been terminated by crimping the contacts. However, this machine is useful for only a specified type of contact and is very bulky. In this machine, a conductor is cut at a predetermined length, the sheath of an end of the conductor is removed, the central conductor is terminated by crimping to a contact or terminal, and the conductor section of the termination is held one by one and inserted into an aperture of the insulating housing. Consequently, it is not only inefficient to assemble a great number of conductors but also likely that the bending by the holding of the conductor section causes poor insertion of the contact.

SUMMARY OF THE INVENTION

Accordingly, it is an object of the invention to provide a small, inexpensive, and efficient connector assembly machine capable of assembling a great number of connectors at once regardless of the facility size.

According to the invention there is provided an electrical connector assembly machine for loading an insulating housing having a plurality of parallel apertures with a plurality of contacts, which comprises a housing support for supporting the insulating housing; a table having a plurality of parallel channels at equal intervals and in registration with the parallel apertures for receiving the contacts; a pusher disposed over the table so as to be movable vertically and laterally along the parallel channels and having a plurality of grooves for receiving conductor sections of the contacts when the pusher is lowered; and the grooves each having at the front edge a jaw portion for pushing forward crimped strain relief tabs of said contact.

In the above assembly machine, terminations are placed in the parallel channels of the table and inserted all at once into the parallel apertures of an insulating housing by means of the pusher. More specifically, the pusher when lowered contacts the conductor sections of the terminations so that its jaw portions push forward the crimped strain relief tabs of the terminations along the parallel channels into the respective parallel apertures.

Other objects, features, and advantages of the invention will be apparent from the following description when taken in conjunction with the accompanying drawings.

DESCRIPTION OF THE PREFERRED EMBODIMENTS

Figure 1:
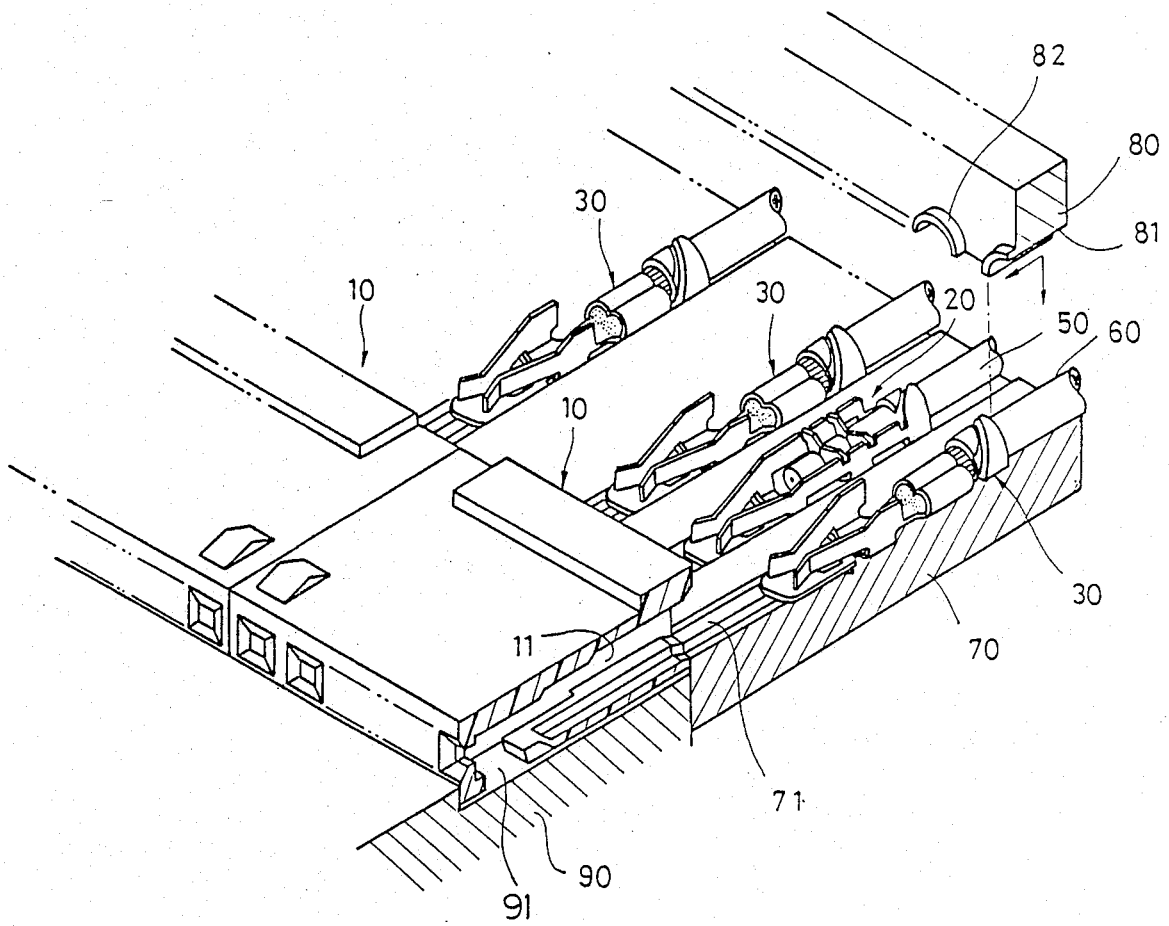
FIG. 1 is a perspective view of an assembling machine according to the present invention.

In FIG. 1, there is shown an electrical connector assembly machine which consists of a table 70, a pusher 80, a number of housings 10, and a housing support 90. A crosswise cut-out 91 is provided on an edge adjacent the table 70 for receiving the insulating housing 10. A number of parallel channels 71 are provided on the table 70 at equal intervals and in registration with parallel apertures 11 of the housing 10. Each aperture 71 is made slightly wider than contacts 20 and 30 so that the contacts may slide into the apertures without difficulty.

The pusher 80, which is disposed over the rear portion of the table 70, has a number of grooves 81 at equal intervals for receiving conductors 50 and 60 of the contacts 20 and 30 placed on the parallel channels 71. Each groove 81 has a metal flange or jaw 82 for pushing forward the crimped strain relief tabs of a conductor. The pusher 80 is made movable vertically and laterally along the parallel channels 71 by an actuator (not shown).

Preferably, the housing support 90 is made movable sideways so as to facilitate arrangement and removal of connector housings. A method of assembling an electrical connector will now be described.

(1) Individual contacts 20 and 30 are terminated to conductors. For the piercing type contacts 20, a well-known piercing tool or machine may be used for termination. Similarly, for the crimping type contacts 30, a well-known crimping tool or machine may be used for termination.

(2) The terminated contacts or terminations 20 and 30 are placed in respective parallel channels 71 of the table 70. A number of housings 10 are placed on the housing support 90 in such a manner that the parallel apertures 11 may register with the respective parallel channels 71 (see FIG. 1).

Figure 2:
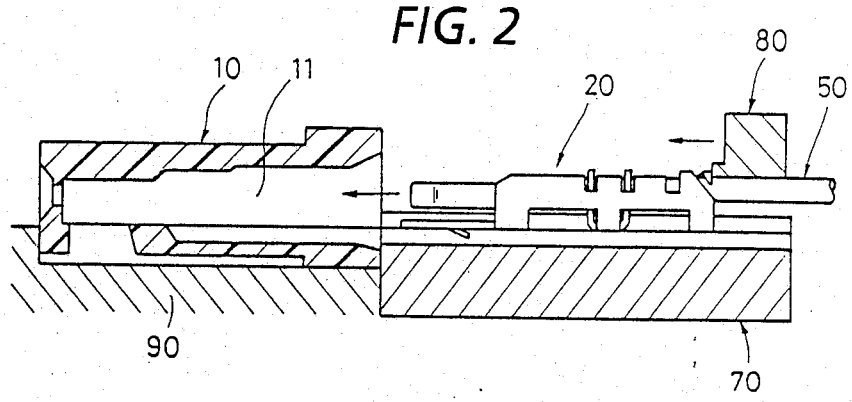
FIGS. 2 and 3 are sectional views of the assembling machine of FIG. 1 before and after a contact is inserted into a connector housing, respectively.
Figure 3:
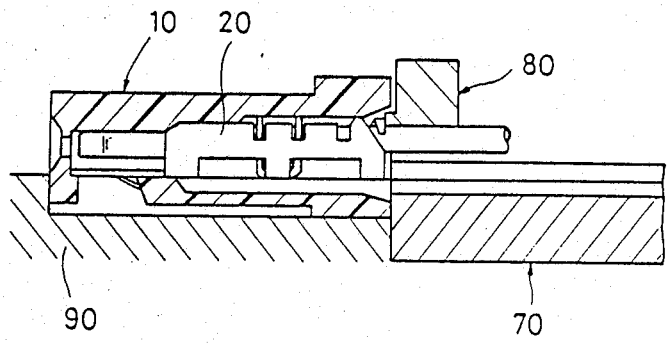

(3) The pusher 80 is lowered until the individual grooves 81 lightly push the conductors of the respective contacts (FIG. 2). The pusher 80 is then moved forward so that the jaws 82 push forward the crimped strain relief tabs of the contacts into the parallel apertures of the housings 10 all at once (FIG. 3). The housing support 90 is moved sideway to remove the completed connectors and load new housings. The above process steps are repeated to continue assembly of connectors.

Preferably, the base portions of piercing and crimping type contacts are made identical in shape and size so that either type or mixed types of contacts may be placed in the identical parallel channels 71 as shown in FIG. 1.

According to the invention there are provided the following advantages:

(1) The structure of the machine according to the invention is very simple, and the number of parts or components is so small that the machine is made compact and easy to maintain, thus reducing the costs.

(2) Since contacts can be terminated to conductors before insertion into a housing, any termination tools or machines available in the market may be used, thus eliminating the need for special tools or machines.

(3) A great number of contacts can be inserted into a number of housings all at once, thus reducing the manufacturing cost.

(4) This assembly machine can be used with a termination machine available in the market to accommodate volume production as well as small-scale production.

(5) Since piercing or crimping type contacts or other similar type contacts may be placed in the parallel channels of the table, various arrangement designs of contacts are possible.

(6) As long as the intervals of parallel apertures are equal, various housings having different numbers of parallel apertures may be placed on the housing support.

While a preferred embodiment of the invention has been described using specific terms, it is to be understood that changes and variations may be made without departing from the spirit and scope of the invention recited in the appended claims.

What is claimed is:

1. An electrical connector assembly machine for loading a plurality of insulating housings each having a plurality of parallel apertures with a plurality of contacts, each having terminated a conductor, which comprises:

a housing support with a crosswise cut-out for receiving said insulating housings slidable along a shoulder of said crosswise cut-out;

a flat table having on its top surface a plurality of parallel channels at equal intervals and in registration with said parallel apertures for receiving said contacts;

an elongated pusher disposed over said table so as to be movable vertically and laterally along said parallel channels and having a plurality of grooves spaced lengthwise at intervals equal to those of said parallel channels for receiving said conductors adjacent said contacts when said pusher is lowered; and said grooves each having at the front edge a jaw portion for pushing forward a rear edge of said contact when said pusher is moved forward along said parallel channels.

2. The electrical connector assembly machine of claim 1, wherein said contacts include piercing and crimping type contacts each having a contacting section for contact with a mating contact and a connecting section for connection with a conductor, and an identically shaped and sized base so that each of said parallel channels and apertures may receive both piercing and crimping type contacts.

* * * * *